US008789305B1

(12) United States Patent
DiChario

(10) Patent No.: US 8,789,305 B1
(45) Date of Patent: Jul. 29, 2014

(54) HYBRID LOWER RECEIVER FOR A RIFLE

(71) Applicant: American Tactical Imports, Inc., Rochester, NY (US)

(72) Inventor: Anthony DiChario, Pittsford, NY (US)

(73) Assignee: American Tactical Imports, Inc., Rochester, NY (US)

( * ) Notice: Subject to any disclaimer, the term of this patent is extended or adjusted under 35 U.S.C. 154(b) by 0 days.

(21) Appl. No.: 13/927,152

(22) Filed: Jun. 26, 2013

(51) Int. Cl.
*F41A 11/02* (2006.01)
*F41A 3/66* (2006.01)

(52) U.S. Cl.
CPC ..... *F41A 3/66* (2013.01)
USPC ..... 42/75.03

(58) Field of Classification Search
CPC ..... F41A 21/482
USPC ..... 42/16, 75.01–75.03
See application file for complete search history.

(56) References Cited

U.S. PATENT DOCUMENTS

| | | | | |
|---|---|---|---|---|
| 7,428,795 | B2 * | 9/2008 | Herring | 42/75.01 |
| 8,141,287 | B2 * | 3/2012 | Dubois | 42/75.02 |
| 8,342,075 | B2 * | 1/2013 | Gomez | 89/191.01 |
| 8,615,917 | B2 * | 12/2013 | Higgins | 42/96 |

* cited by examiner

*Primary Examiner* — Reginald Tillman, Jr.
(74) *Attorney, Agent, or Firm* — Woods Oviatt Gilman LLP; Katherine H. McGuire, Esq.

(57) ABSTRACT

A combination metal/polymer lower receiver for use in a rifle. The lower receiver attaches to a buttstock including a receiver extension, and an upper receiver having a bolt carrier group. The lower receiver comprises a polymeric lower receiver housing having an integral polymeric upwardly extending lobe. The polymeric receiver housing engages with mounting features on the upper receiver to attach the lower receiver to the upper receiver. A metal insert is secured within the polymeric upwardly extending lobe and engages the receiver extension. The metal insert includes insert side walls incorporated within the polymer sidewalls of the lower receiver housing such that the sidewalls are adapted to receive a take-down pin to secure the upper receiver to the lower receiver. The metal insert can further include an elevated plate for displaying component identifiers.

3 Claims, 7 Drawing Sheets

HYBRID LOWER RECEIVER FOR A RIFLE

FIELD OF THE INVENTION

The present invention relates to a rifle, and more particularly, to a modular automatic or semi-automatic assault-type rifle. Specifically, the present invention relates to a lower receiver assembly configured for use within a modular assault-type rifle.

BACKGROUND OF THE INVENTION

There are a number of automatic and semi-automatic rifles used by military personnel as well as law enforcement and civilians. While fully automatic rifles are generally illegal for use by the civilian population, many of the components which constitute an automatic rifle are the same as those found within semi-automatic models legalized for civilian use. Arguably the most popular semi-automatic assault-type rifle used by civilians, particularly within the United States, is the AR-15 and its clones. AR-15 is a registered trademark of Colt Industries. A number of additional companies manufacture clones of the AR-15 and market these clones under separate trademarks. While used throughout the specification, it is to be understood that the term AR-15 is meant to include not only those rifles manufactured by Colt Industries, but also those additional clones and any variants thereof. The AR-15 is the semi-automatic variant of the fully automatic M16 rifle used by United States military personnel.

The AR-15 and M16 are designed as modular rifles generally comprising a buttstock, lower receiver, upper receiver and barrel assembly. Each component is separable from one another and affords rifle owners the opportunity to customize the rifle with after-market components such as barrels of differing lengths, upper receivers designed to handle different calibers of ammunition, flashlights, hand guards, grenade or flare launchers, flash or sound suppressors, grips, and front or rear sights. To operate, the lower receiver is configured to include a trigger and magazine box wherein activation of the trigger causes a round (bullet) housed within the chamber of the upper receiver to be fired out the barrel of the rifle by action of a reciprocating bolt carrier group housed within the upper receiver. Internal mechanisms of the upper receiver expel the shell casing of the fired round from the chamber while components engaged with the magazine box housed within the lower receiver feed a new round into the now-empty chamber. The buttstock mounts to the lower receiver and includes a buffer assembly and action (or recoil) spring in communication with the bolt carrier group. After a spent shell has been discharged, the spring urges the bolt carrier group back toward the chamber in preparation for firing another round.

The modular construction of these rifles enables generally quick and easy field-stripping (disassembly of the rifle for cleaning of the rifle to ensure proper firing of the weapon). In field-stripping the rifle, the lower receiver is separated from the upper receiver to gain access to the firing mechanism (bolt, bolt carrier and associated mechanisms) for cleaning and re-lubrication. When assembled, the upper and lower receivers are secured to one another through rear and forward extensions on the upper receiver fitting between corresponding sidewalls forming notches or grooves on the lower receiver. The forward sidewalls and extension are fitted with a pivot pin to prevent the forward halves of the receivers from separating. Similarly, the rear sidewalls and extension employ a takedown pin to secure the two receivers together. To field-strip the rifle, the takedown pin is sufficiently pushed out of the extension so as to enable the rear extension to lift out of the rear sidewalls thereby pivoting the lower and upper receivers about the pivot pin. The pivot pin can then be pushed out a sufficient distance so as to enable removal of the front extension from the front sidewalls and thereby completing separation of the lower receiver from the upper receiver.

While the AR-15 and M16 can be constructed of aircraft grade forged aluminum, a trend in manufacturing current firearms/firearm components is to interchange metal parts/components with high strength polymeric materials, such as glass reinforced nylon, whenever possible. These polymeric parts/components decrease the weight of the rifle while also decreasing material costs associated with fabrication of the rifle or individual rifle parts. One drawback in polymeric components, however, is the eventual wear of these components after repeated field-stripping, cleaning and reassembly. This is of particular importance with regard to the lower receiver and the takedown and pivot pins. Any substantial wear to any of the components results in an unsafe and unusable firearm. A further drawback to a polymeric lower receiver is the potential for fatigue or cracking of the lower receiver upon dropping of the weapon. Specifically, the lower receiver includes an upper lobe which is used to mount a receiver extension (which is housed within the buttstock) to the lower receiver. The buffer assembly and action (recoil) spring is housed within this receiver extension. Dropping the rifle such that the buttstock strikes a surface with sufficient force or at an angle, or after repeated drops, the polymeric upper lobe can crack or completely fracture from the remainder of the lower receiver thereby causing misalignment between the buffer assembly and bolt carrier group resulting in a dangerous or inoperable firearm.

As such, there is a need for a lower receiver assembly which capitalizes upon the weight and cost savings afforded by polymeric materials while also enjoying the mechanical and structural strength afforded by metal (i.e. aircraft grade aluminum). The present invention addresses these and other needs.

BRIEF SUMMARY OF THE INVENTION

In general, one embodiment the present invention is directed to a lower receiver assembly constructed as a polymeric/metal hybrid wherein the bulk of the lower receiver assembly is constructed of molded polymeric materials while at least a portion of the upper lobe is constructed of a metal.

Preferably, the metal portion of the upper lobe is configured to be surrounded by the polymeric portion of the hybrid lower receiver such that the upper lobe is a single, contiguous construction with the remainder of the lower receiver. The metal portion is positioned so as to engage the receiver extension and rifle buttstock. More preferably, the metal portion further extends to occupy at least a portion of the rear sidewalls of the lower receiver such that the takedown pin passes through the metal portion when attaching the lower receiver to the upper receiver.

Accordingly, in one embodiment of the present invention, a combination polymeric/metal lower receiver for use in a rifle is provided. The lower receiver is adapted for removable attachment to a buttstock including a receiver extension having a recoil spring and buffer assembly, and an upper receiver having a bolt, bolt carrier and charging handle. The lower receiver includes a polymeric lower receiver housing having an integral polymeric upwardly extending lobe. A metal insert is secured within the polymeric lower receiver at the location of the lobe. The metal insert is preferably configured to permit detachable engagement of the hybrid lower receiver with the receiver extension component of the rifle assembly while the polymeric receiver housing is adapted to permit detachable engagement with the upper receiver component of the rifle assembly.

The metal insert may further include a pair of spaced side walls which may extend within the spaced side walls of the polymeric lower receiver housing, respectively. The metal insert and polymeric lower receiver housing may further include aligned through-holes wherethrough a takedown pin may removably pass to secure the upper receiver component of the rifle assembly to the hybrid lower receiver.

In a further embodiment, the hybrid lower receiver includes a metal inserted adapted to display an elevated plate through a corresponding opening in the polymeric housing. The elevated plate displays component identifiers, such as through casting or engraving, in compliance with applicable state, federal and/or international laws and regulations.

The embodiments of the present invention are well-suited to reduce material costs while also maintaining structural integrity of the lower receiver assembly even after multiple cleanings of the rifle or when subjected to severe or repeated drops.

Additional objects, advantages and novel features of the present invention will be set forth in part in the description which follows, and will in part become apparent to those in the practice of the invention, when considered with the attached figures.

BRIEF DESCRIPTION OF THE DRAWINGS

The accompanying drawings form a part of this specification and are to be read in conjunction therewith, wherein like reference numerals are employed to indicate like parts in the various views, and wherein.

DETAILED DESCRIPTION OF THE INVENTION

Figure 1:
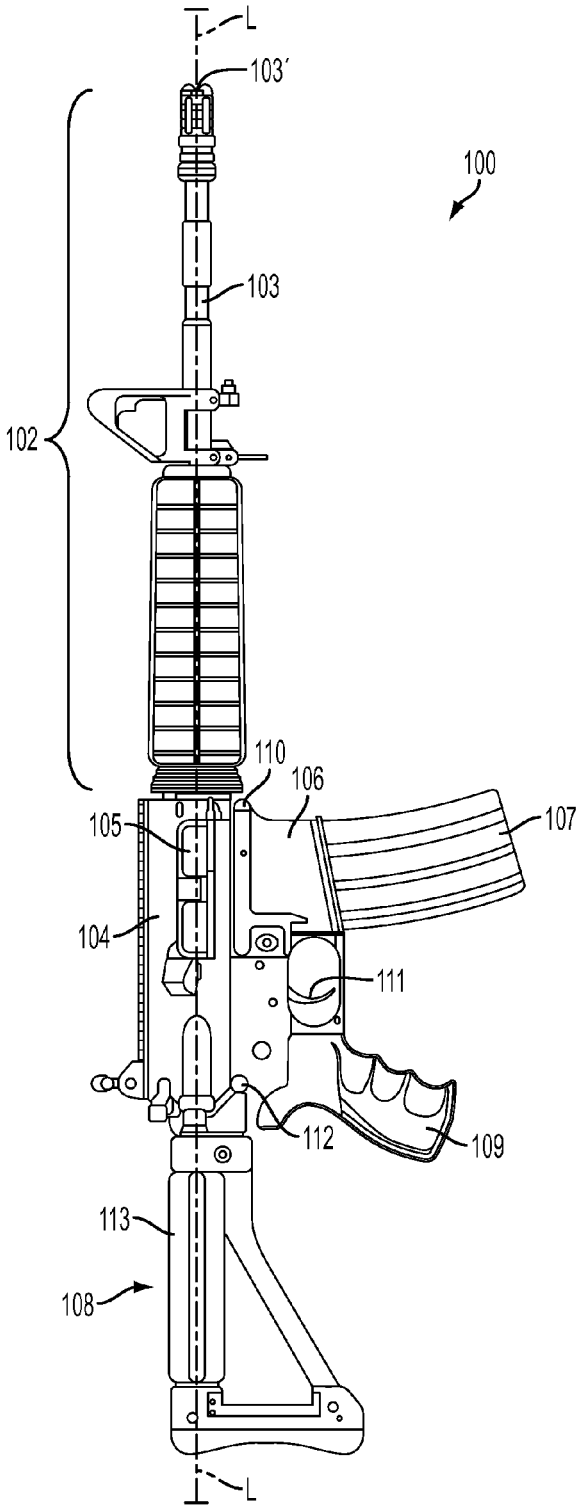
FIG. 1 is a side view of a representative modular rifle suitable for incorporating an embodiment of a lower receiver in accordance with present invention.

Referring to the drawings in detail, and specifically to FIG. 1, a rifle, such as the AR-15, is generally indicated by reference numeral 100. Rifle 100 is a modular firearm consisting of a number of components and subcomponents. Major components of rifle 100 include barrel assembly 102, upper receiver 104, lower receiver 106 and buttstock 108. To assemble a completed rifle, upper receiver 104 is positioned atop lower receiver 106 such that front and rear projections on the upper receiver (not shown) rest within a notch or groove formed by sidewalls 110' and 112', respectively, of the lower receiver (see FIG. 2). Each projection and respective sidewalls include a corresponding through-hole. Sidewall through-holes 110" and 112" are configured to align with a respective through-hole of the upper receiver whereby a pin is inserted into and passes within each through-hole to secure the two receivers together. Pivot pin 110 detachably secures the front projection of the upper receiver within the lower receiver while takedown pin 112 secures the rear projection.

Upper receiver 104 houses the chamber 105 which holds a round (bullet) in position for firing, along with the firing mechanism to initiate discharge of the round. The firing mechanism generally includes a bolt, bolt carrier, charging handle and related mechanisms. Barrel assembly 102 is secured to upper receiver 104 generally through a threaded connection and includes a barrel 103 in operational communication with the chamber of the upper receiver such that a round fired from the chamber 105 passes down the length of the barrel and exits the firearm at barrel end 103'. Rounds are introduced into the chamber by way of magazine 107 fitted to the lower receiver. Activation of the firing mechanism is controlled by trigger 111. A grip 109 (such as a pistol grip, as shown) allows the user to aim and control the rifle while placing the user's trigger index finger in close proximity to the trigger. In this manner, the user can aim the rifle to the target and extend the trigger index finger to engage the trigger without losing control or accuracy of the rifle.

Figure 2:
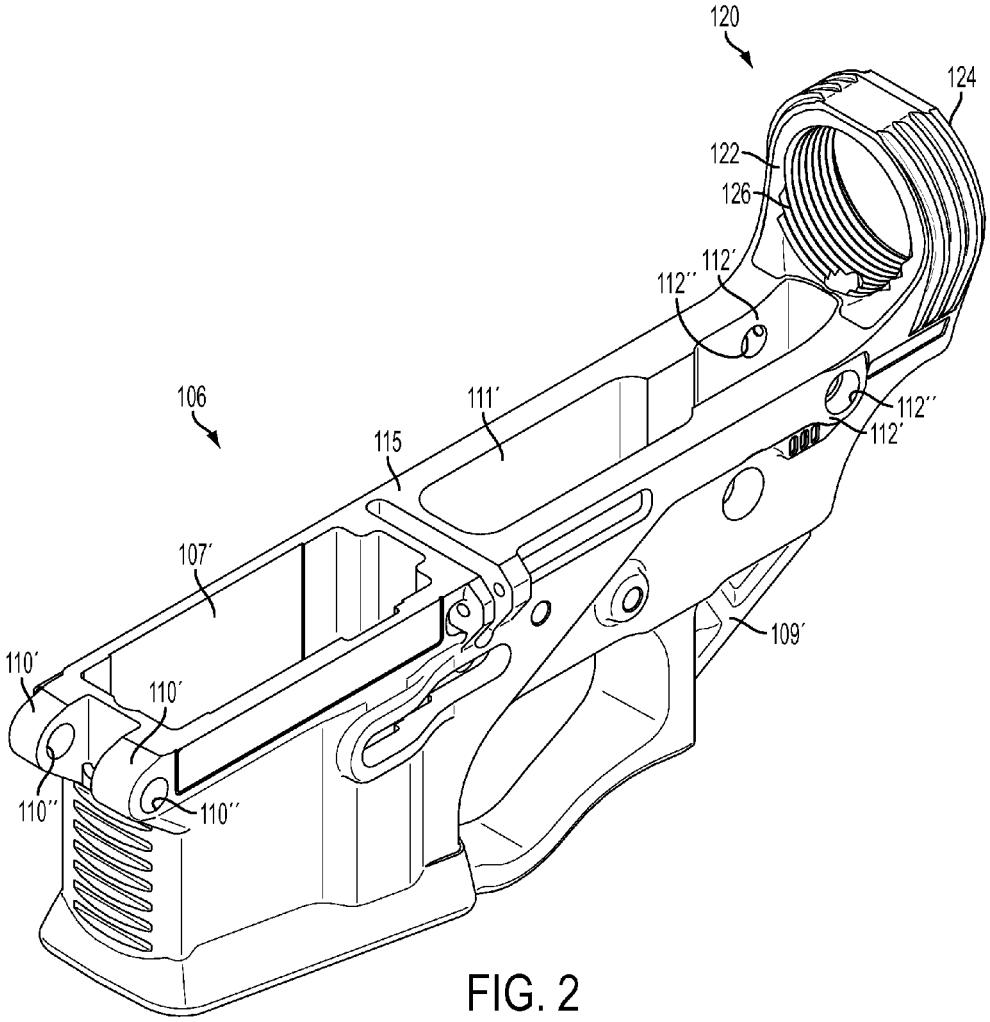
FIG. 2 is a perspective view of a lower receiver in accordance with an embodiment of the present invention.

Lower receiver 106 includes an upwardly extending lobe 120 (see FIG. 2). Buttstock 108 is detachably mounted to upwardly extending lobe 120 so that a receiver extension 113 is in operational alignment with the bolt carrier housed within the upper receiver. Receiver extension 113 generally houses an action (or recoil) spring and buffer assembly (not shown). Upon discharge of a round, the bolt carrier within the upper housing is driven rearward by action of the gas discharged by the firing action. The buffer assembly and action spring dampen the kickback experienced by the user while also redirecting the firing mechanism back toward the chamber in preparation for firing another round.

Modular rifles are generally constructed of aircraft grade forged aluminum. However, a current manufacturing trend is to interchange metal parts/components with high strength polymeric materials, such as glass reinforced nylon, whenever possible, including both the upper and lower receivers. Polymeric parts/components decrease the weight of the rifle while also decreasing material costs associated with fabrication of the rifle parts. One drawback in polymeric components, however, is the eventual wear of these components after repeated field-stripping, cleaning and reassembly. This is of particular importance with regard to the lower receiver and the takedown and pivot pins. Any substantial wear to any of these particular components results in an unsafe and unusable firearm. A further drawback to a polymeric lower receiver is the potential for fatigue or cracking of the lower receiver upon dropping of the weapon, particularly where the upwardly extending lobe begins its upward projection from the main body of the lower receiver. The upper lobe 120 of the lower receiver is used to mount the receiver extension 113 (See FIG. 1). Repeated or violent dropping the rifle, particularly drops causing the buttstock 108 (within which is housed receiver extension 113) to strike a surface with sufficient force and/or at an angle can cause the upwardly extending lobe to crack, fracture or shear from the remainder of the lower receiver thereby causing misalignment between the buffer assembly and bolt carrier group resulting in a dangerous or inoperable firearm.

Figure 3:
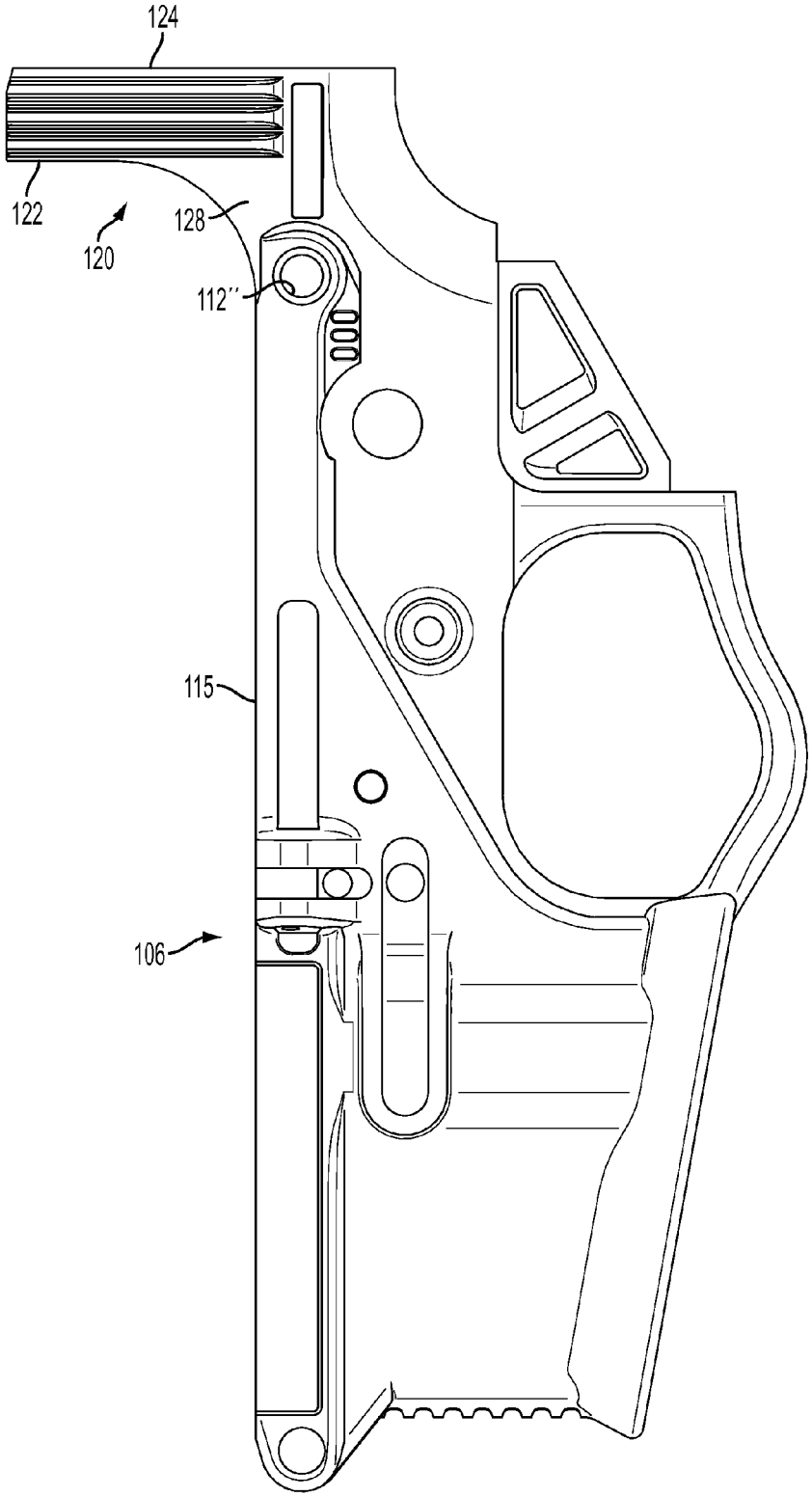
FIG. 3 is a side view of a lower receiver in accordance with an embodiment of the present invention.

As shown in FIGS. 2 and 3, lower receiver 106 has a generally rectangular side profile and includes an upwardly extending lobe 120. Top surface 115 is a generally flat surface configured with openings for accepting the internal mechanisms required to operate the rifle. For instance, opening 107' is configured to accept an ammunition magazine 107 and associated hardware to direct rounds loaded within the magazine into the chamber in the upper receiver. Opening 111' houses mechanical components which engage the trigger 111 with the bolt carrier group in the upper receiver so that manipulation of the trigger results in firing of the rifle. Lower receiver 106 is further adapted with a grip mounting interface 109' for securing, for example, a pistol grip 109.

When assembled (as shown in FIG. 1), the upper receiver 104 mounts along lower receiver top surface 115 and abuts inner surface 122 of the upwardly extending lobe 120. Outer surface 124 of the upwardly extending lobe 120 engages with receiver extension 113 to mount buttstock 108 to lower receiver 106. Upwardly extending lobe 120 has a generally circular threaded through-hole 126 which is adapted to receive the mating male threads on the receiver extension 113. Through-hole 126 permits operational communication between the buffer assembly and action spring housed within the receiver extension (not shown) with the bolt carrier group (not shown) within the upper receiver which is mounted along top surface 115, as shown in FIG. 1. As shown most clearly in FIG. 3, upwardly extending lobe 120 forms a generally 90 degree elbow 128 with top surface 115. As the buttstock has a sole mounting surface along outer surface 124 of upwardly extending lobe 120, any force applied to the buttstock which is not along the longitudinal axis L of the rifle is directed at elbow 128. Repeated stress to elbow 128, such as by dropping the rifle on the buttstock, may lead to mechanical failure of the elbow, particularly when that elbow is constructed from a polymeric material.

Figure 4:
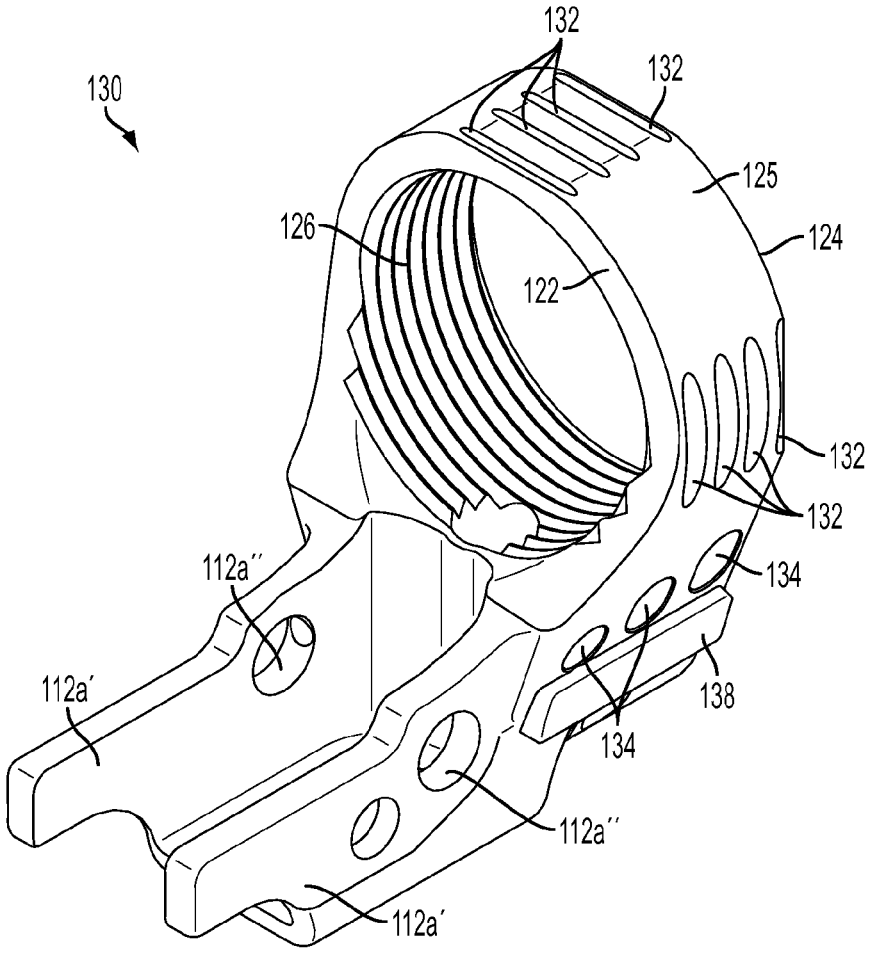
FIG. 4 is a perspective view of a metal insert incorporated within a lower receiver in accordance with an embodiment of the present invention.
Figure 5:
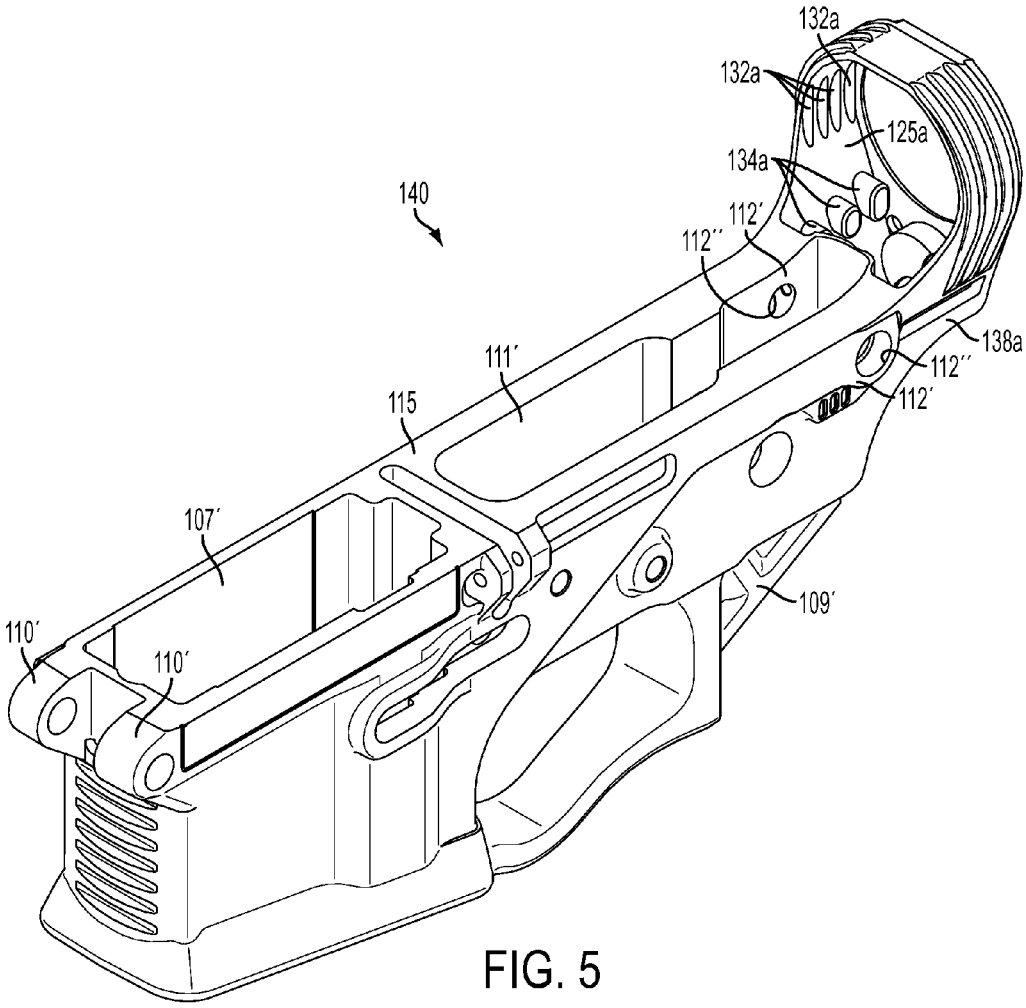
FIG. 5 is a perspective view of a polymeric lower receiver housing in accordance with an embodiment of the present invention.

Accordingly, as shown in FIGS. 4-7, the lower receiver of the present invention is constructed as an integrated hybrid polymer/metal unit wherein a metal insert 130 (FIG. 4) is secured within a polymeric lower receiver housing 140 (FIG. 5). Metal insert 130 can be constructed of any suitable metal, and is preferably constructed of aircraft grade aluminum. Similarly, the polymeric lower receiver housing 140 can be constructed of any suitable polymeric material, and is preferably constructed of glass reinforced nylon.

Figure 6:
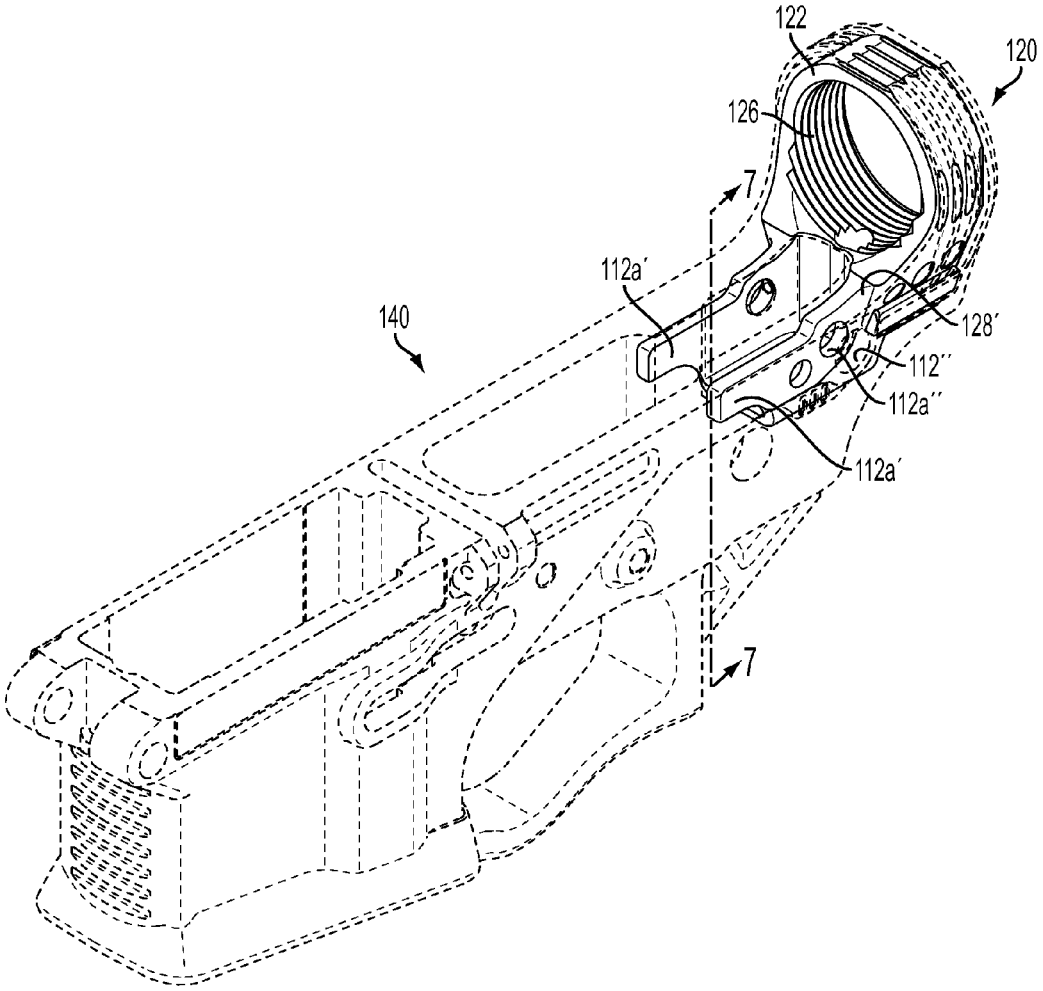
FIG. 6 is an environmental view of a lower receiver in accordance with an embodiment of the present invention showing an embedded metal insert in solid lines with a polymeric lower receiver housing shown in dashed lines.
Figure 7:
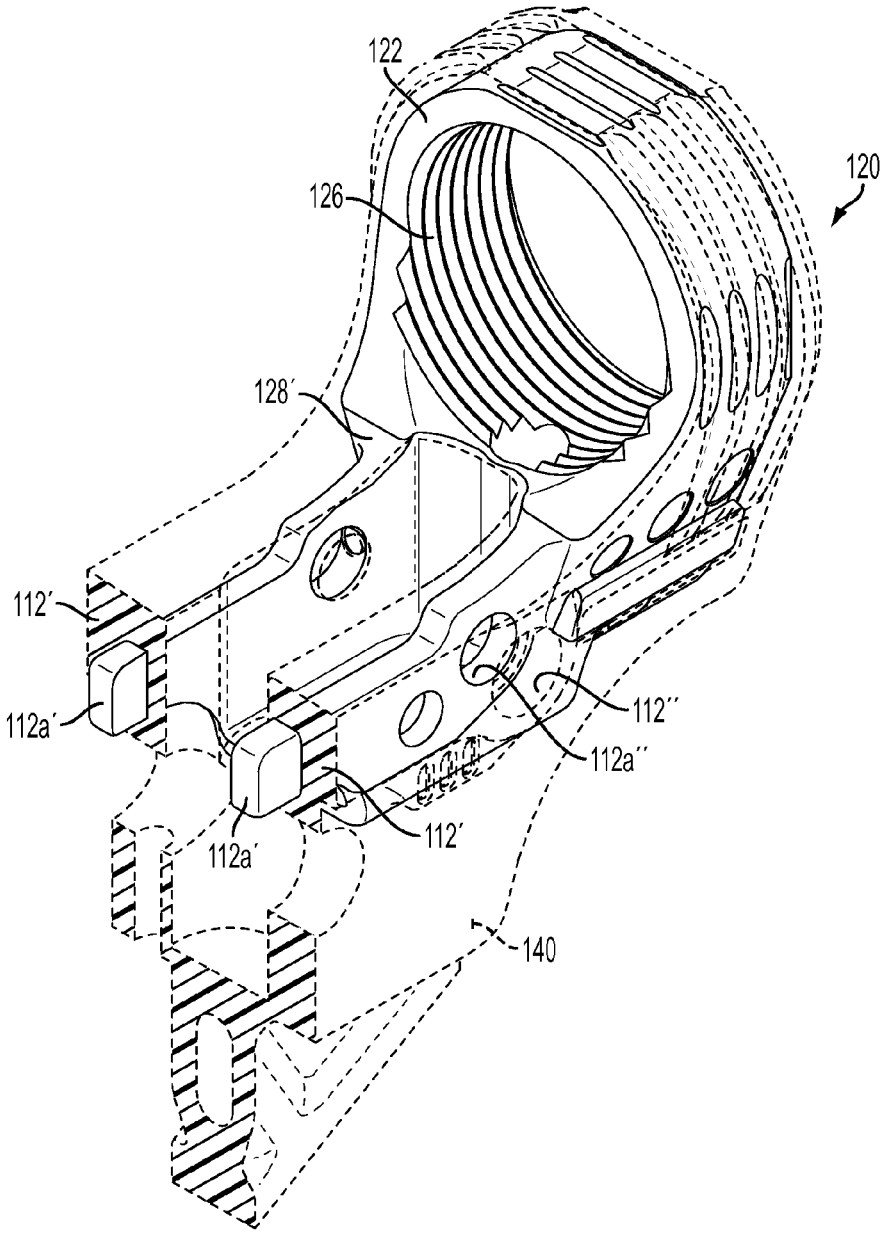
FIG. 7 is a cross-sectional view of a lower receiver in accordance with an embodiment of the present invention as taken generally along the line 7-7 of FIG. 6.

In a preferred embodiment, as seen in FIGS. 6 and 7, metal insert 130 includes the interior portion of upwardly extending lobe 120, and more specifically defines the threaded through-hole 126, as well as the inner surface 122 and outer surface 124 which contact the upper receiver and receiver extension, respectively. As the threaded through-hole 126 is constructed out of the metal insert 130, the internal threads of the upwardly extending lobe gain the benefits of an all-metal lower receiver (more robust threads that are less likely to become stripped or cross-threaded upon repeated engagement/disengagement of the corresponding threads of the receiver extension 113) while the remainder of lower receiver gains the benefits of a polymeric lower receiver (lighter materials and less expensive material and fabrication costs).

As seen in FIG. 4, exterior surface 125 of the metal insert 130 is preferably adapted to include a plurality of recess 132 and wells 134. Exterior surface 125 is configured to mate with interior surface **125*a* of polymeric housing 140. Directing attention to FIG. 5, polymeric housing 140 further includes protrusions 132*a* which engage recesses 132 and nodules 134*a* which engage wells 134. Mating elements 132/132*a* and 134/134*a*** lock the metal insert within the polymeric housing and prevent lateral displacement of the metal insert when subjected to a kickback force (such as that experienced immediately following discharge of the rifle) or when the lower receiver is being physically tampered with by a user. While described as having a metal insert with recesses and wells and a polymeric housing with protrusions and nodules, it would be appreciated by one skilled in the art that the orientation of these features can be reversed or combined in any suitable configuration so as to perform the intended function.

Turning again to FIGS. 6 and 7, metal insert 130 further extends through an elbow 128' to define sidewalls **112*a*' having takedown pin through-holes 112*a*". Preferably sidewalls 112*a*' are embedded within polymeric sidewalls 112' such that metal insert takedown pin through-holes 112*a*" correspond with takedown pin through-holes 112" situated on the polymeric housing 140 thereby enabling selective engagement/disengagement of takedown pin 112. Metal sidewalls 112*a*' defining through-holes 112*a*" minimize wear to the lower receiver and takedown pin when the lower receiver is separated from the upper receiver for cleaning and re-lubrication. Metal sidewalls 112*a*', by extending through the elbow to form a unitary metal insert with the threaded portion of the upwardly extending lobe 120**, increases the structural stability of the elbow of the integrated polymer/metal hybrid lower receiver. This hybrid polymer/metal elbow resists cracking or fracturing such as that experienced by a solely polymeric lower receiver while also minimizing component weight and manufacturing costs by decreasing the amount of the metal used to construct the lower receiver.

In a further embodiment, metal insert 130 is fabricated to include an elevated plate 138, Elevated plate 138 is incorporated in and passes through plate opening **138*a* on polymeric housing 140. Elevated plate 138 allows for the marking of a serial number or other identifier upon the lower receiver in compliance with 27 C.F.R. §479.102. In a preferred embodiment, the elevated plate 138** is conspicuously placed on the lower receiver and, by being incorporated within the metal insert, is not susceptible to being readily obliterated, altered or removed. The size, position and/or orientation of the elevated plate can be modified as desired or necessitated so as to enable marking of the lower receiver in satisfaction of any state, federal or international law or regulation.

Although the present invention has been described in considerable detail with reference to certain aspects thereof, other versions are possible. Therefore, the spirit and scope of the appended claims should not be limited to the description of the aspects contained herein.

All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A combination metal/polymer lower receiver for use in a rifle, the lower receiver being adapted to be detachably attached to a buttstock including a receiver extension having a recoil spring and buffer assembly, and an upper receiver having a bolt, bolt carrier and charging handle, the lower receiver comprising:

a) a polymeric lower receiver housing having an integral polymeric upwardly extending lobe configured to receive the receiver extension therethrough, the polymeric lower receiver housing adapted to detachably engage with mounting features on the upper receiver to attach said lower receiver to said upper receiver; and b) a metal insert rigidly secured within the polymeric upwardly extending lobe wherein the metal insert is adapted to detachably engage the receiver extension.

2. The combination metal/polymer lower receiver of claim 1 wherein said metal insert further includes insert side walls embedded within respective polymer sidewalls of said polymeric lower receiver housing such that the polymer/metal side walls are adapted to detachably engage a rear mounting feature of said upper receiver.

3. The combination metal/polymer lower receiver of claim 1 wherein said metal insert further includes an elevated plate, wherein the elevated plate is disposed within a plate opening on said polymeric lower receiver housing.

* * * * *